US010861640B2

(12) United States Patent
Peng et al.

(10) Patent No.: US 10,861,640 B2
(45) Date of Patent: Dec. 8, 2020

(54) MAGNETIC ASSEMBLY AND BASE THEREOF

(71) Applicant: DELTA ELECTRONICS, INC., Taoyuan (TW)

(72) Inventors: Hsien-Chun Peng, Taoyuan (TW); Chun-Ching Yen, Taoyuan (TW); Kun-Te Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 350 days.

(21) Appl. No.: 15/849,184

(22) Filed: Dec. 20, 2017

(65) Prior Publication Data

US 2019/0066910 A1 Feb. 28, 2019

(30) Foreign Application Priority Data

Aug. 23, 2017 (TW) ..... 106212503 U

(51) Int. Cl.

| | |
|---|---|
| ***H01F 27/29*** | (2006.01) |
| ***H01F 17/04*** | (2006.01) |
| ***H01F 41/061*** | (2016.01) |
| ***H01F 27/26*** | (2006.01) |
| ***H01F 27/06*** | (2006.01) |
| *H01F 3/10* | (2006.01) |

(52) U.S. Cl.

CPC ..... *H01F 27/292* (2013.01); *H01F 17/043* (2013.01); *H01F 17/045* (2013.01); *H01F 27/06* (2013.01); *H01F 27/266* (2013.01); *H01F 41/061* (2016.01); *H01F 2003/106* (2013.01); *H01F 2027/065* (2013.01); *H01F 2027/297* (2013.01)

(58) Field of Classification Search

CPC ..... H01F 27/292; H01F 27/266; H01F 27/06; H01F 17/043; H01F 41/061; H01F 17/045; H01F 2027/065; H01F 2003/106; H01F 2027/297

See application file for complete search history.

(56) References Cited

U.S. PATENT DOCUMENTS 4,924,200 A * 5/1990 Kitahara ..... H01F 5/04 336/192

7,474,187 B1 * 1/2009 Huang ..... H01F 27/027 336/65

(Continued)

*Primary Examiner* — Tuyen T Nguyen

(74) *Attorney, Agent, or Firm* — Kirton McConkie; Evan R. Witt

(57) ABSTRACT

A magnetic assembly includes a magnetic core, two windings, and a base. The windings are arranged around the magnetic core, and each of the windings has two leading sections. The base carries the magnetic core, and comprises a frame part, a pin base, and two first pins and two second pins disposed on the pin base. The pin base is connected with the frame part, and has four through holes. Two first pins are disposed in two of the through holes, and two second pins are disposed in the other two of the through holes. Each of the first pins and the second pins has two extending parts extended from the first surface and the second surface respectively, and the leading sections of the windings are connected with the first pins and the second pins respectively. Therefore, the advantages of decreasing the production costs and product standardization are achieved.

18 Claims, 7 Drawing Sheets

(56) References Cited

U.S. PATENT DOCUMENTS

| | | | | |
|---|---|---|---|---|
| 8,896,404 | B2 * | 11/2014 | Won | H01F 5/02 336/182 |
| 2004/0041676 | A1 * | 3/2004 | Okamoto | H01F 27/027 336/90 |
| 2012/0280779 | A1 * | 11/2012 | Shih | H01F 27/306 336/196 |

* cited by examiner

MAGNETIC ASSEMBLY AND BASE THEREOF

CROSS-REFERENCE TO RELATED APPLICATION

This application claims priority from Taiwanese Patent Application No. TW 106212503, filed on Aug. 23, 2017, the entire contents of which are incorporated herein by reference for all purposes.

FIELD OF THE INVENTION

The present invention relates to a magnetic assembly and a base thereof, and more particularly to a base for mounting the magnetic assembly vertically or horizontally.

BACKGROUND OF THE INVENTION

With the advances in science and technology, a variety of electronic products are flourishing, and kinds of magnetic assemblies are used to satisfy the required circuit design in the electronic products. For example, by setting chokes or inductors, the electric energy in the circuit can be stored or released to regulate the current, thereby stabilizing the current in the circuit and filtering out the noise.

In conventional magnetic assemblies, the windings are generally arranged around the magnetic cores and then mounted on a base, on which the metal pins are disposed. The windings are fixed to the pins through the soldering operation after the arrangement of the windings is completed, and the magnetic assemblies are inserted into the circuit board through the pins, thereby producing corresponding effects on the circuit of the electronic products.

The magnetic assemblies can be produced and inserted on the circuit boards vertically or horizontally according to their differences in components or winding methods, and each of the magnetic assemblies has to be matched with the corresponding base. However, in prior arts, the design of the base only can be applied to a single specific type of magnetic assemblies (i.e. the vertical type or the horizontal type), such that the base can not be shared, and fails to decentralize the production scale. Furthermore, in order to meet the requirements of winding and solder, the volumes of the conventional bases are large, and the bases take up much space.

Therefore, there is a need of providing a magnetic assembly and a base thereof to solve the drawbacks in prior arts, make the base being shared for utilization in vertical type magnetic assembly and horizontal type magnetic assembly, decentralize the production scale, be beneficial to the automatic production, use the space effectively, and achieve the advantages of decreasing the production costs and product standardization.

SUMMARY OF THE INVENTION

It is an object of the present invention to provide a magnetic assembly and a base thereof in order to solve the drawbacks of prior art.

The present invention provides a magnetic assembly and a base thereof. By disposing different types of pins on the pin base of the base, the base can be applied in the magnetic assemblies for vertical type and horizontal type, such that the production scale is decentralized, and the advantages of decreasing the production costs and product standardization are achieved.

The present invention also provides a magnetic assembly and a base thereof. Through disposing different types of pins along different directions, the windings can be selected to be connected with the pins which are easier to be soldered and fixed, and the magnetic assembly can be assembled with different design requirements, thereby decreasing the production difficulty, and being beneficial to the automatic production.

The present invention also provides a magnetic assembly and a base thereof. Through defining an accommodation space with the frame part and the pin base, which have a step between each other, the magnetic core and the windings can be partially disposed in the accommodation space. Through the design of sinking the magnetic core and the windings into the base, the volume of the magnetic assembly can be decreased, and the space can be used effectively.

In accordance with an aspect of the present invention, there is provided a magnetic assembly. The magnetic assembly comprises a magnetic core, two windings, and a base. The windings are arranged around the magnetic core, and each of the windings has two leading sections. The base carries the magnetic core, and comprises a frame part, a pin base, two first pins, and two second pins. The pin base is connected with the frame part. The pin base has four through holes, a first surface and a second surface opposite to the first surface, and the four through holes penetrates the first surface and the second surface. The first pins are disposed in two of the through holes, and each of the first pins has two extending parts extended from the first surface and the second surface respectively. The second pins are disposed in the other two of the through holes, and each of the second pins has two extending parts extended from the first surface and the second surface respectively. The leading sections of the windings are connected with the first pins and the second pins respectively.

In accordance with an aspect of the present invention, there is provided a magnetic assembly. The magnetic assembly comprises a magnetic core, a winding, and a base. The winding is arranged around the magnetic core, and the winding has two leading sections. The base carries the magnetic core, and comprises a frame part, a pin base, and two pins. The pin base is connected with the frame part. The pin base has two through holes, a first surface and a second surface opposite to the first surface, and the two through holes penetrates the first surface and the second surface. The pins are disposed in the two through holes, and each of the pins has two extending parts extended from the first surface and the second surface respectively. The two leading sections of the winding are connected with the two pins respectively.

In accordance with an aspect of the present invention, there is provided a base of a magnetic assembly for carrying a magnetic core. The base comprises a frame part, a pin base, two first pins, and two second pins. The pin base is connected with the frame part. The pin base has four through holes, a first surface and a second surface opposite to the first surface, and the four through holes penetrates the first surface and the second surface. The first pins are disposed in two of the through holes, and each of the first pins has two extending parts extended from the first surface and the second surface respectively. The second pins are disposed in the other two of the through holes, and each of the second pins has two extending parts extended from the first surface and the second surface respectively.

In accordance with an aspect of the present invention, there is provided a base of a magnetic assembly for carrying a magnetic core. The base comprises a frame part, a pin base, and two pins. The pin base is connected with the frame part. The pin base has four through holes, a first surface and a second surface opposite to the first surface, and the four through holes penetrates the first surface and the second surface. The pins are disposed in the two through holes, and each of the pins has two extending parts extended from the first surface and the second surface respectively.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
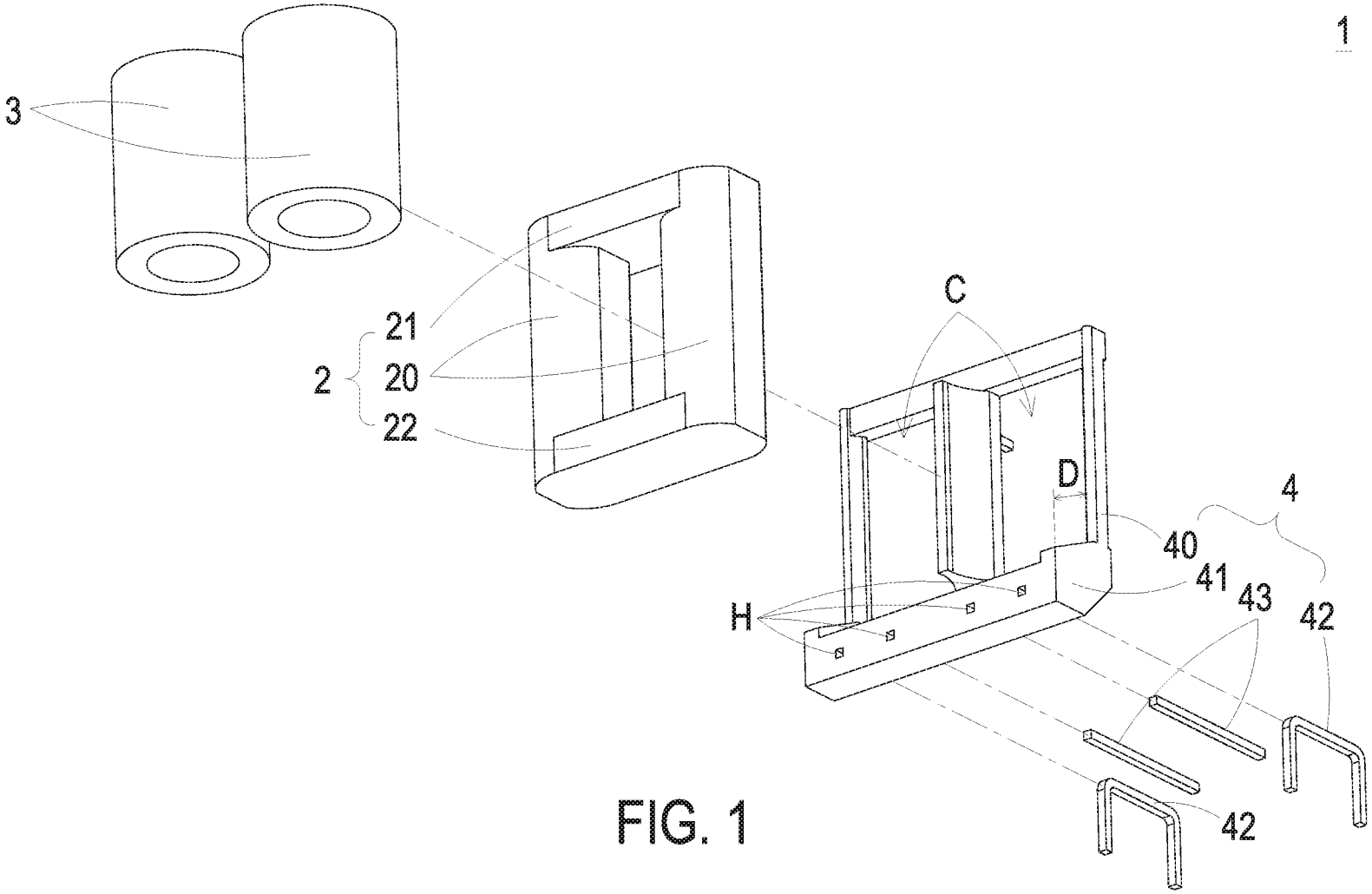
FIG. 1 schematically illustrates the exploded structure of a magnetic assembly according to an embodiment of the present invention.
Figure 2:
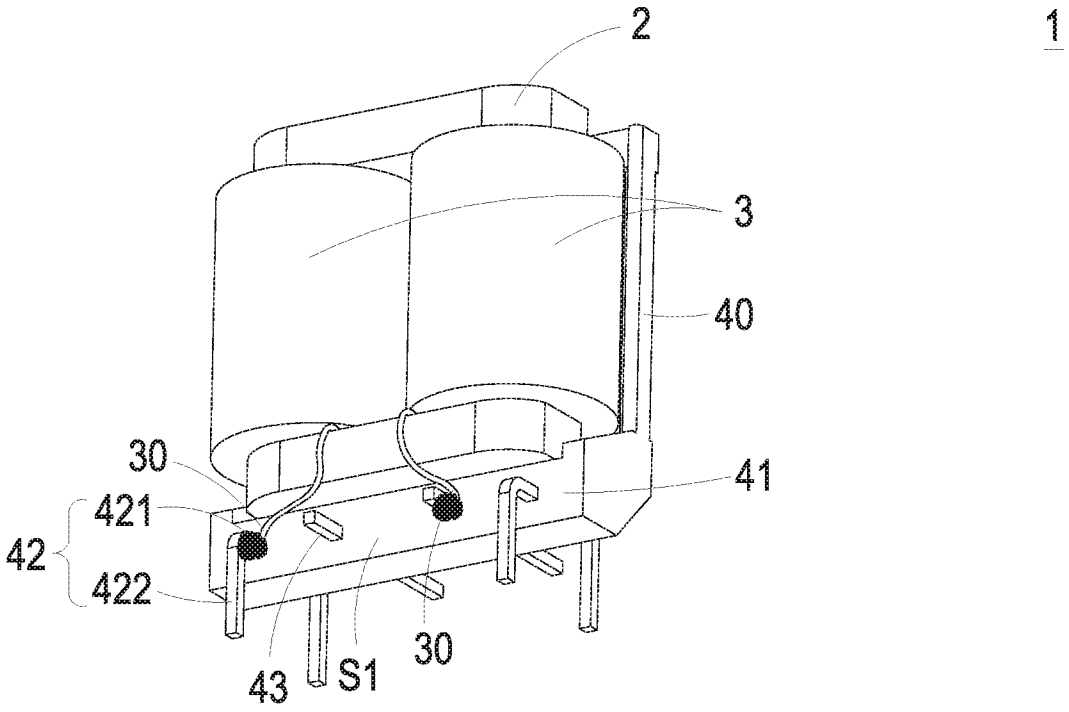
FIG. 2 schematically illustrates a side view of a magnetic assembly according to an embodiment of the present invention.
Figure 3:
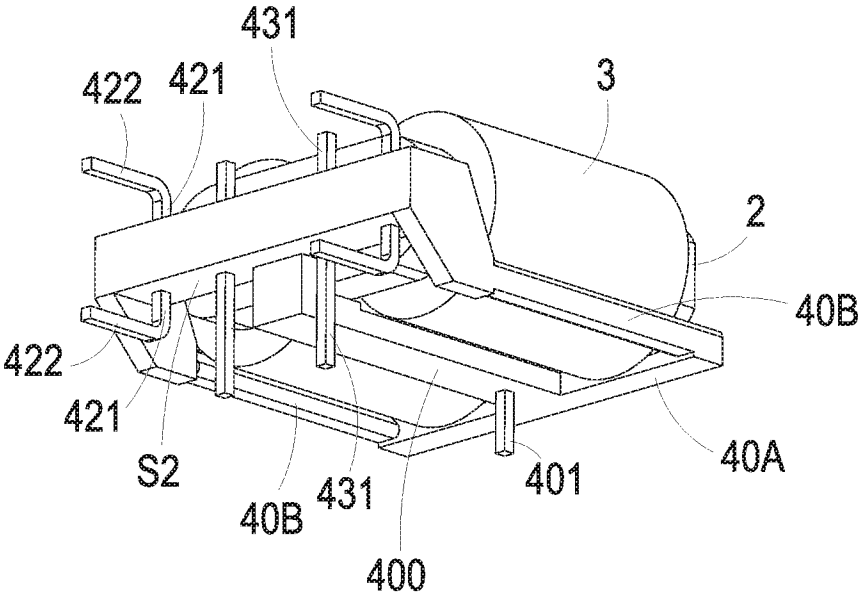
FIG. 3 schematically illustrates another side view of the magnetic assembly as shown in FIG. 2.
Figure 4:
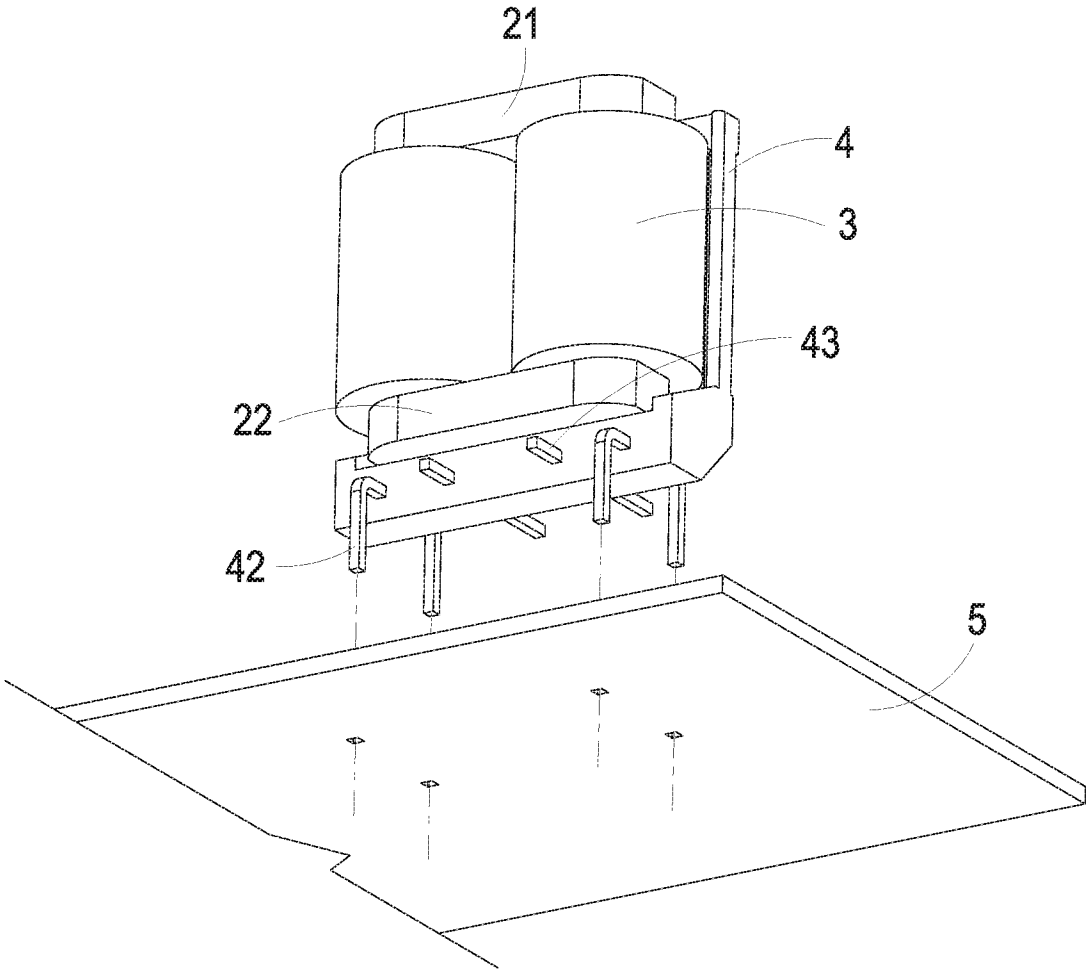
FIG. 4 schematically illustrates the structure of a magnetic assembly and a circuit board using the same according to an embodiment of the present invention.

Please refer to FIG. 1, FIG. 2, FIG. 3, and FIG. 4. FIG. 1 schematically illustrates the exploded structure of a magnetic assembly according to an embodiment of the present invention. FIG. 2 schematically illustrates a side view of a magnetic assembly according to an embodiment of the present invention. FIG. 3 schematically illustrates another side view of the magnetic assembly as shown in FIG. 2. FIG. 4 schematically illustrates the structure of a magnetic assembly and a circuit board using the same according to an embodiment of the present invention. As shown in FIG. 1, FIG. 2, FIG. 3, and FIG. 4, the magnetic assembly 1 of the present invention comprises a magnetic core 2, two winding 3, and a base 4. The windings 3 are arranged around the magnetic core 2, and each of the windings 3 has two leading sections 30. The base 4 carries the magnetic core 2, and comprises a frame part 40, a pin base 41, two first pins 42, and two second pins 43. The pin base 41 is connected with the frame part 40. The pin base has four through holes H, a first surface S1 and a second surface S2 opposite to the first surface S1, and the four through holes H penetrates the first surface S1 and the second surface S2. The magnetic assembly 1 may be a choke, the material of the base 4 may be insulation materials, and the material of the first pins 42 and the second pins 43 may be metal, but not limited herein.

The first pins 42 are disposed in two of the through holes H, and each of the first pins 42 has two extending parts 421 extended from the first surface S1 and the second surface S2 respectively. The second pins 43 are disposed in the other two of the through holes H, and each of the second pins 43 has two extending parts 431 extended from the first surface S1 and the second surface S2 respectively. The leading sections 30 of each of the windings 3 are connected with the first pins 42 and the second pins 43 respectively. For example, each of the connection between the four leading sections 30, the two first pins 42 and the two second pins 43 is one-to-one connection, but not limited herein.

In this embodiment, each of the first pins 42 has two stretching parts 422 connected to the two extending parts 421 of each of the first pins 42 respectively. Further, the two extending parts 421 of each of the first pins 42 are perpendicular to the first surface S1 and the second surface S2 respectively, and the two stretching parts 422 of each of the first pins 42 are perpendicular to the two extending parts 421 of each of the first pins 42 respectively.

In this embodiment, the two extending parts 431 of each of the second pins 43 are perpendicular to the first surface S1 and the second surface S2 respectively, and the length of each of the extending parts 431 of the second pins 43 is larger than the length of each of the extending parts 421 of the first pins 42, but not limited thereto.

In other embodiment, each of the second pins 43 has two stretching parts connected to the two extending parts 431 of each of the second pins 43 respectively. The stretching parts of the second pins 43 can be identical to the stretching parts 422 of the first pins 42, so that the first pins 42 and the second pins 43 are all U-type pins, but not limited herein. Because the stretching parts of the first pins 42 and the second pins 43 are formed by bending each two opposite ends of each of the first pins 42 and the second pins 43, in some embodiments, the first pins 42 and the second pins 43 have no stretching part, so that the first pins 42 and the second pins 43 are all I-type pins. Otherwise, the first pins 42 and the second pins 43 can be permutation of U-type pins and/or I-type pins according to actual requirement.

In some embodiments, the frame part 40 has a middle post 400, and the two first pins 42 are disposed symmetrically with respect to the middle post 400 on the pin base 41, and the two second pins 43 are disposed symmetrically with respect to the middle post 400 on the pin base 41 and between the four first pins 42, but not limited herein. In some embodiments, the middle post 400 of the frame part 40 further has a fixing pin 401, such that when the magnetic assembly 1 is inserted into the circuit board 5 horizontally, the fixing pin 401 is inserted into the circuit board 5, so that the magnetic assembly 1 can be fixed on the circuit board 5 more stably.

In some embodiments, the magnetic assembly 1 is vertically inserted into the circuit board 5 through the stretching parts 422 of the first pins 42, but not limited herein. In some embodiments, the leading sections 30 of the two windings 3 of the magnetic assembly 1 are connected with the extending parts 421, 431, respectively, and the magnetic assembly 1 is vertically inserted into the circuit board 5 through the stretching parts 422 of the first pins 42, but not limited thereto.

In some embodiments, the leading sections 30 of the two windings 3 are connected with the first pins 42 and the second pins 43, respectively, and the magnetic assembly 1 is horizontally inserted into the circuit board 5 through the extending parts 431 extended form the second surface S2, but not limited herein.

Figure 5:
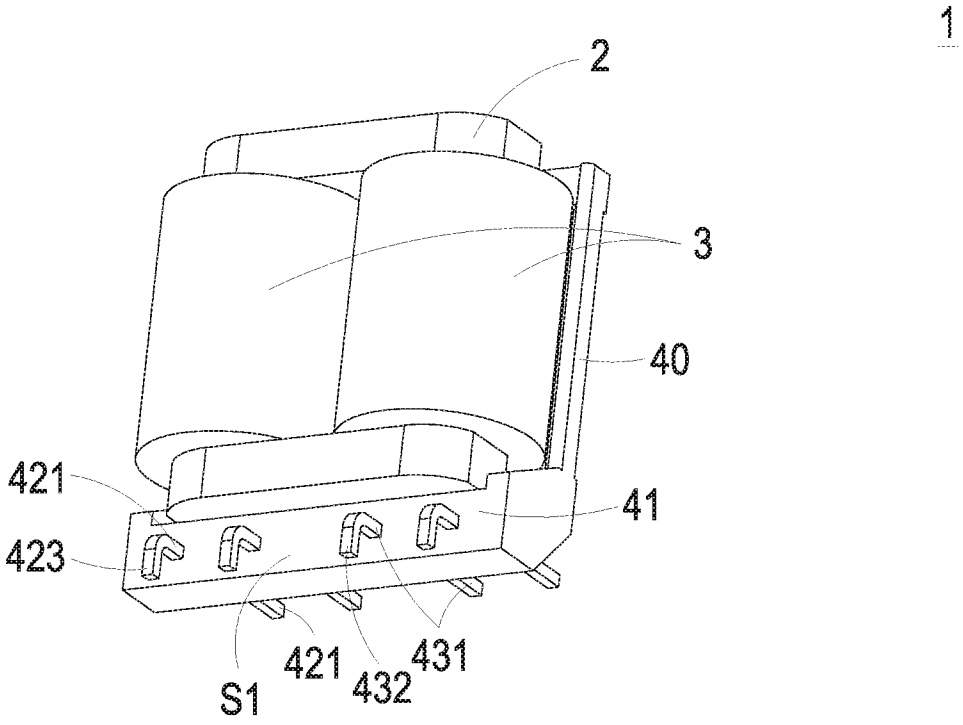
FIG. 5 schematically illustrates a side view of a magnetic assembly according to another embodiment of the present invention.
Figure 6:
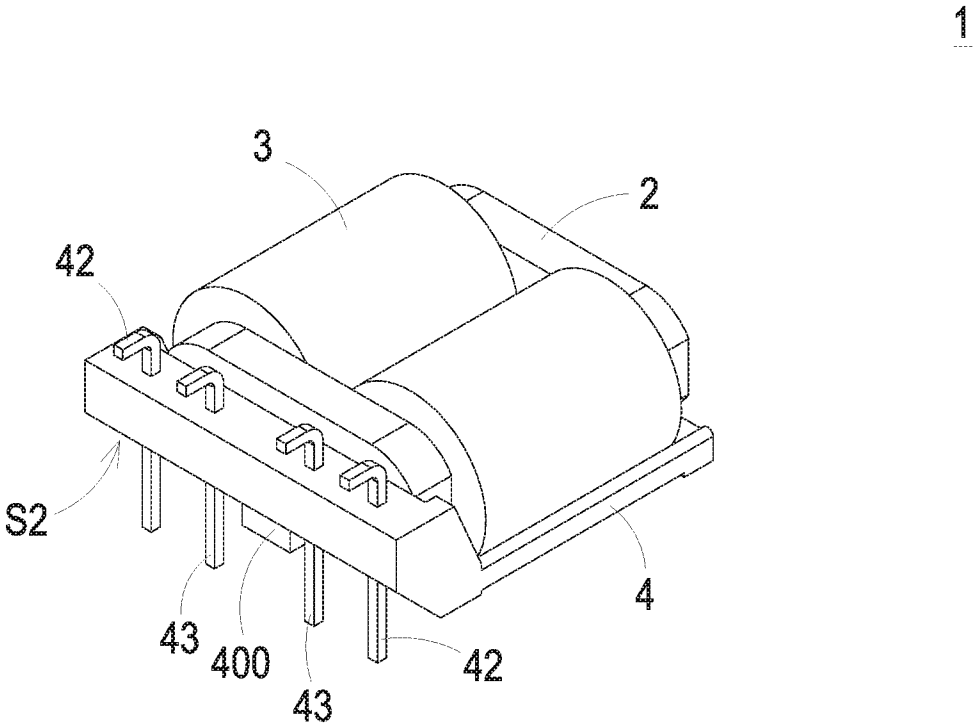
FIG. 6 schematically illustrates another side view of the magnetic assembly as shown in FIG. 5.
Figure 7:
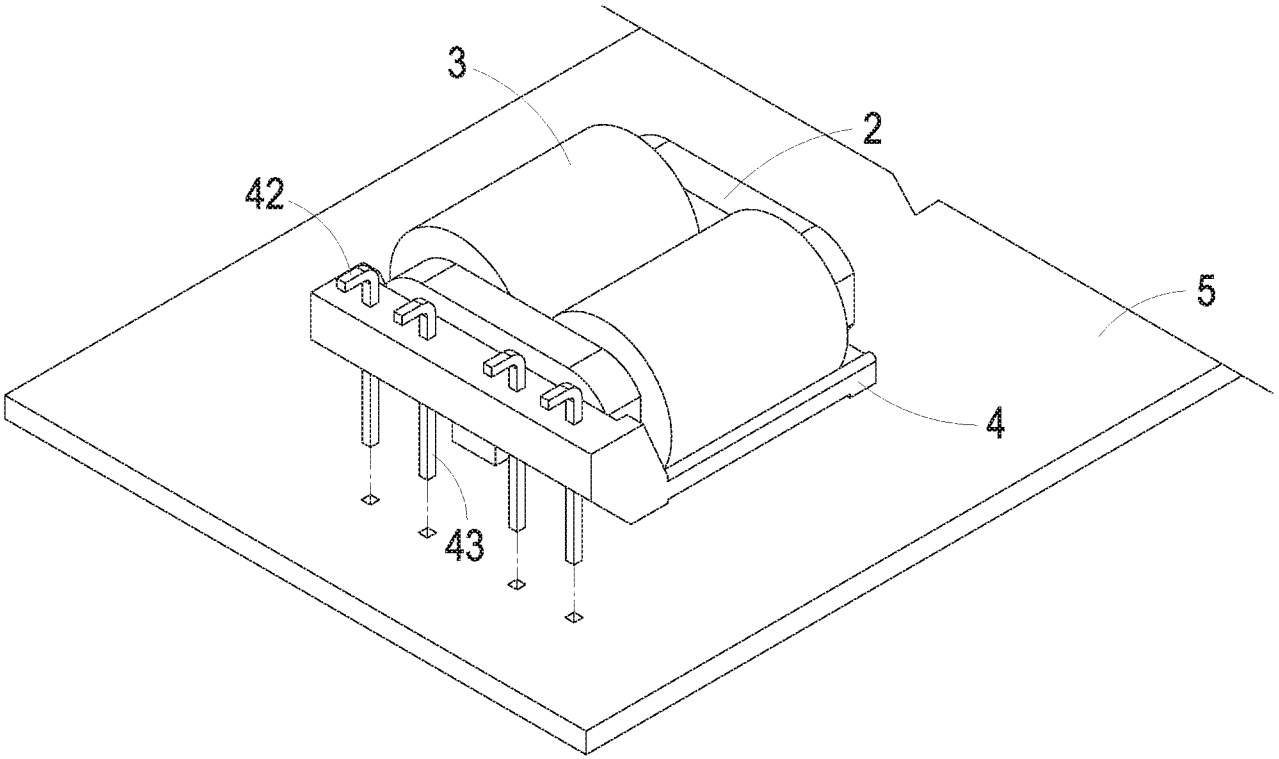
FIG. 7 schematically illustrates the structure of a magnetic assembly as shown in FIG. 6 and a circuit board using the same.

Please refer to FIG. 5, FIG. 6, and FIG. 7. FIG. 5 schematically illustrates a side view of a magnetic assembly according to another embodiment of the present invention. FIG. 6 schematically illustrates another side view of the magnetic assembly as shown in FIG. 5. FIG. 7 schematically illustrates the structure of a magnetic assembly as shown in FIG. 6 and a circuit board using the same. As shown in FIG. 5, FIG. 6, and FIG. 7, each of the first pins 42 further has a stretching part 423, and the two extending parts 421 of each of the first pins 42 are perpendicular to the first surface S1 and the second surface S2 respectively, the stretching part 423 of each of the first pins 42 are connected to and perpendicular to one of the two extending parts 421 of each of the first pins 42 respectively.

In some embodiments, each of the second pins 43 has a stretching part 432, and the two extending parts 431 of each of the second pins 43 are perpendicular to the first surface S1 and the second surface S2 respectively, the stretching part 432 of each of the second pins 43 are connected to and perpendicular to one of the two extending parts 431 of each of the second pins 43 respectively. For example, the first pins 42 and the second pins 43 can be L-type pins, but not limited herein.

In some embodiments, the leading sections 30 of the two windings 3 are connected with the first pins 42 and the second pins 43, respectively, and the magnetic assembly 1 is horizontally inserted into the circuit board 5 through the extending parts 421, 431 extended from the second surface S2*f*, but not limited thereto.

In some embodiments, the leading sections 30 of the two windings 3 are connected with the first pins 42 and the second pins, respectively, and the magnetic assembly 1 is vertically inserted into the circuit board 5 through the stretching parts 423, 432, but not limited herein.

In brief, in the magnetic assembly of the present invention, by disposing different types of pins on the pin base of the base, the base can be applied in the magnetic assemblies for vertical type and horizontal type, such that the production scale is decentralized, and the advantages of decreasing the production costs and product standardization are achieved. Furthermore, through disposing different types of pins along different directions, the windings can be selected to be connected with the pins which are easier to be soldered and fixed, and the magnetic assembly can be assembled with different design requirements, thereby decreasing the production difficulty, and being beneficial to the automatic production.

Please refer to FIG. 1, FIG. 2, and FIG. 3. As shown in FIG. 1, FIG. 2, and FIG. 3, an accommodation space C is defined by the frame part 40 and the pin base 41, and the magnetic core 2 and the windings 3 are partially disposed in the accommodation space C. In some embodiments, a step D is formed between the pin base 41 and the frame part 40. The frame part 40 has a first segment 40A, two opposite second segments 40B, and a middle post 400, among which the two ends of the two second segments 40B are respectively connected with the first segment 40A and the pin base 41. The middle post 400 is connected with the first segment 40A and the pin base 41, and two accommodation spaces C are defined by the first segment 40A, the two second segments 40B, the middle post 400, and the pin base 41, and the magnetic core 2 and the winding 3 are partially disposed in the two accommodation spaces C.

The magnetic core 2 of the magnetic assembly 1 can further has two lateral posts 20. The two windings 3 are respectively arranged around the two lateral posts 20, and the two lateral posts 20 and the two windings 3 are correspondingly and partially disposed in the two accommodation spaces C. In some embodiments, the magnetic core 2 further comprises a top post 21 and a bottom post 22. The two ends of the top post 21 are respectively connected with ends of one side of the two lateral posts 20, the two ends of the bottom post 22 are respectively connected with ends of the other one side of the two lateral posts 20, and the bottom post 22 is disposed against the pin base 41. For example, the magnetic core 2 can be a quadrilateral magnetic core, but not limited thereto.

In brief, in the magnetic assembly of the present invention, through defining an accommodation space with the frame part and the pin base, which have a step between each other, the magnetic core and the windings can be partially disposed in the accommodation space. Furthermore, through the design of sinking the magnetic core and the windings into the base, the volume of the magnetic assembly can be decreased, and the space can be used effectively.

In some embodiments, the magnetic assembly 1 of the present invention comprises a magnetic core 2, a winding 3, and a base 4. The base 4 comprises a frame part 40, a pin base 41, and two pins. The pin base 41 has two through holes, and the two pins are disposed in the two through holes. The rest structures of the magnetic core 2, the winding 3, the frame part 40, and the pin base 41 are described in the embodiments mentioned above. In some embodiments, one of the pins has a stretching part connected to one of the extending parts of the pin. In some embodiments, one of the pins has two stretching parts connected to the two extending parts of the pin respectively. Furthermore, in some embodiments, each of the pins has a stretching part connected to one of the extending parts of each of the pins respectively. In some embodiments, each of the pins has two stretching parts connected to the two extending parts of the pins respectively, but not limited herein.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic assembly, comprising:

a magnetic core;

two windings arranged around the magnetic core, wherein each of the windings has two leading sections; and a base carrying the magnetic core and comprising:

a frame part;

a pin base connected with the frame part, wherein the pin base has four through holes, a first surface and a second surface opposite to the first surface, and the four through holes penetrates the first surface and the second surface;

two first pins disposed in two of the through holes, and each of the first pins has two extending parts extended from the first surface and the second surface respectively; and two second pins disposed in the other two of the through holes, and each of the second pins has two extending parts extended from the first surface and the second surface respectively, wherein the leading sections of the windings are connected with the first pins and the second pins respectively, wherein a step is formed between the pin base and the frame part, and the frame part has a first segment, two opposite second segments, and a middle post, and wherein the two second segments are respectively connected with the first segment, the middle post is connected with the first segment and the pin base, and two accommodation spaces are defined by the first segment, the two second segments, the middle post, and the pin base, and the magnetic core and the windings are partially disposed in the two accommodation spaces.

2. The magnetic assembly according to claim 1, wherein each of the first pins has two stretching parts connected to the two extending parts of each of the first pins respectively.

3. The magnetic assembly according to claim 2, wherein the two extending parts of each of the first pins are perpendicular to the first surface and the second surface respectively, and the two stretching parts of each of the first pins are perpendicular to the two extending parts of each of the first pins respectively.

4. The magnetic assembly according to claim 3, wherein the two extending parts of each of the second pins are perpendicular to the first surface and the second surface respectively, and the length of each of the extending parts of the second pins is larger than the length of each of the extending parts of the first pins.

5. The magnetic assembly according to claim 2, wherein the frame part has a middle post, the two first pins are disposed symmetrically with respect to the middle post on the pin base, and the two second pins are disposed symmetrically with respect to the middle post on the pin base and between the two first pins.

6. The magnetic assembly according to claim 2, wherein each of the second pins has two stretching parts connected to the two extending parts of each of the second pins respectively.

7. The magnetic assembly according to claim 1, wherein each of the first pins has a stretching part, and the two extending parts of each of the first pins are perpendicular to the first surface and the second surface respectively, the stretching part of each of the first pins are connected to and perpendicular to one of the two extending parts of each of the first pins respectively.

8. The magnetic assembly according to claim 7, wherein each of the second pins has a stretching part, and the two extending parts of each of the second pins are perpendicular to the first surface and the second surface respectively, the stretching part of each of the second pins are connected to and perpendicular to one of the two extending parts of each of the second pins respectively.

9. The magnetic assembly according to claim 1, wherein the frame part has a middle post, and the first pins and the second pins are disposed symmetrically with respect to the middle post on the pin base.

10. The magnetic assembly according to claim 1, wherein the magnetic core has two lateral posts, and wherein the two windings are respectively arranged around the two lateral posts, and the two lateral posts and the two windings are disposed in the two accommodation spaces.

11. The magnetic assembly according to claim 10, wherein the magnetic core further comprises a top post and a bottom post, and wherein two ends of the top post are respectively connected with ends of one side of the two lateral posts, two ends of the bottom post are respectively connected with ends of the other one side of the two lateral posts, and the bottom post is disposed against the pin base.

12. A magnetic assembly, comprising:

a magnetic core;

a winding arranged around the magnetic core, wherein the winding has two leading sections; and a base carrying the magnetic core and comprising:

a frame part;

a pin base connected with the frame part, wherein the pin base has two through holes, a first surface and a second surface opposite to the first surface, and the two through holes penetrates the first surface and the second surface; and two pins disposed in the two through holes, and each of the pins has two extending parts extended from the first surface and the second surface respectively, wherein the two leading sections of the winding are connected with the two pins respectively, wherein a step is formed between the pin base and the frame part, and the frame part has a first segment, two opposite second segments, and a middle post, and wherein the two second segments are respectively connected with the first segment, the middle post is connected with the first segment and the pin base, and two accommodation spaces are defined by the first segment, the two second segments, the middle post, and the pin base, and the magnetic core and the windings are partially disposed in the two accommodation spaces.

13. The magnetic assembly according to claim 12, wherein one of the pins has a stretching part connected to one of the extending parts of the pin.

14. The magnetic assembly according to claim 12, wherein one of the pins has two stretching parts connected to the two extending parts of the pin respectively.

15. The magnetic assembly according to claim 12, wherein each of the pins has a stretching part connected to one of the extending parts of each of the pins respectively.

16. The magnetic assembly according to claim 12, wherein each of the pins has two stretching parts connected to the two extending parts of the pins respectively.

17. A base of a magnetic assembly for carrying a magnetic core, comprising:

a frame part;

a pin base connected with the frame part, wherein the pin base has four through holes, a first surface and a second surface opposite to the first surface, and the four through holes penetrates the first surface and the second surface;

two first pins disposed in two of the through holes, and each of the first pins has two extending parts extended from the first surface and the second surface respectively; and two second pins disposed in the other two of the through holes, and each of the second pins has two extending parts extended from the first surface and the second surface respectively, wherein a step is formed between the pin base and the frame part, and the frame part has a first segment, two opposite second segments, and a middle post, and wherein the two second segments are respectively connected with the first segment, the middle post is connected with the first segment and the pin base, and two accommodation spaces are defined by the first segment, the two second segments, the middle post, and the pin base, and the magnetic core is partially disposed in the two accommodation spaces.

18. A base of a magnetic assembly for carrying a magnetic core, comprising:

a frame part;

a pin base connected with the frame part, wherein the pin base has two through holes, a first surface and a second surface opposite to the first surface, and the two through holes penetrates the first surface and the second surface; and two pins disposed in the two through holes, and each of the pins has two extending parts extended from the first surface and the second surface respectively, wherein a step is formed between the pin base and the frame part, and the frame part has a first segment, two opposite second segments, and a middle post, and wherein the two second segments are respectively connected with the first segment, the middle post is connected with the first segment and the pin base, and two accommodation spaces are defined by the first segment, the two second segments, the middle post, and the pin base, and the magnetic core is partially disposed in the two accommodation spaces.

* * * * *